United States Patent [19]

Hsieh

[11] Patent Number: 4,770,215

[45] Date of Patent: Sep. 13, 1988

[54] WOOD BAR ROUNDING MACHINE WITH TWO OR MORE CUTTING AND SANDING UNITS

[76] Inventor: Sung-Shui Hsieh, No. 25-10, Nan Yang Road, Feng Yuan City, Taichung Hsien, Taiwan

[21] Appl. No.: 60,696

[22] Filed: Jun. 11, 1987

[51] Int. Cl.[4] ..... B27C 9/00

[52] U.S. Cl. ..... 144/4; 51/5 C; 51/145 R; 144/3 R; 144/367

[58] Field of Search ..... 51/5 C, 145; 144/2 R, 144/4, 1 R, 3 R, 27, 28, 30, 41, 66, 69, 90, 109, 110, 119, 126, 367

[56] References Cited

U.S. PATENT DOCUMENTS 4,519,429 5/1985 Dreese ..... 144/4

4,630,660 12/1986 McGuire ..... 144/4

FOREIGN PATENT DOCUMENTS 105508 9/1942 Sweden ..... 144/4

*Primary Examiner*—W. Donald Bray

*Attorney, Agent, or Firm*—Varndell Legal Group

[57] ABSTRACT

A wood bar rounding machine which has two or more cutting and sanding units arranged concentrically so that a rectangular timber can be rounded and polished to a desired size. The desired product in a high quality can be obtained by a series of sequential steps of rough cutting and fine cutting and sanding after the wood is inserted at the front end and fed automatically by feed rollers.

5 Claims, 3 Drawing Sheets

WOOD BAR ROUNDING MACHINE WITH TWO OR MORE CUTTING AND SANDING UNITS

BACKGROUND AND SUMMARY OF THE INVENTION

An automatic wood bar rounding machine is a woodworking machine designed to make rounded bars from rectangular or irregular timber for further processing into legs, posts or balusters. However, it is difficult for a conventional machine to make a desired round bar from a rectangular timber all at once. In other words, a rectangular wood bar must be roughly cut by one machine, finely cut by another machine or another cutting unit, and polished by still another machine. In order to make rounded and polished wood bars, a carpenter's shop must have several cutting and sanding machines or cutting and polishngn units ready. It is not only costly, but also time consuming, to make round bars using several cutting and sanding machines.

In order to eliminate these disadvantages, the present invention was developed. A main objective of this invention is to provide a wood bar rounding machine which has two or more cutting and sanding units arranged concentrically on a stand for synchronous or separate operation, so that a desired round bar can be obtained all at once by a series of rough cutting fine cutting and sanding. Another objective of this invention is to provide a wood bar rounding machine, which can make desired round bars at one time, so as to save money and time.

DETAILED DESCRIPTION

Figure 1:
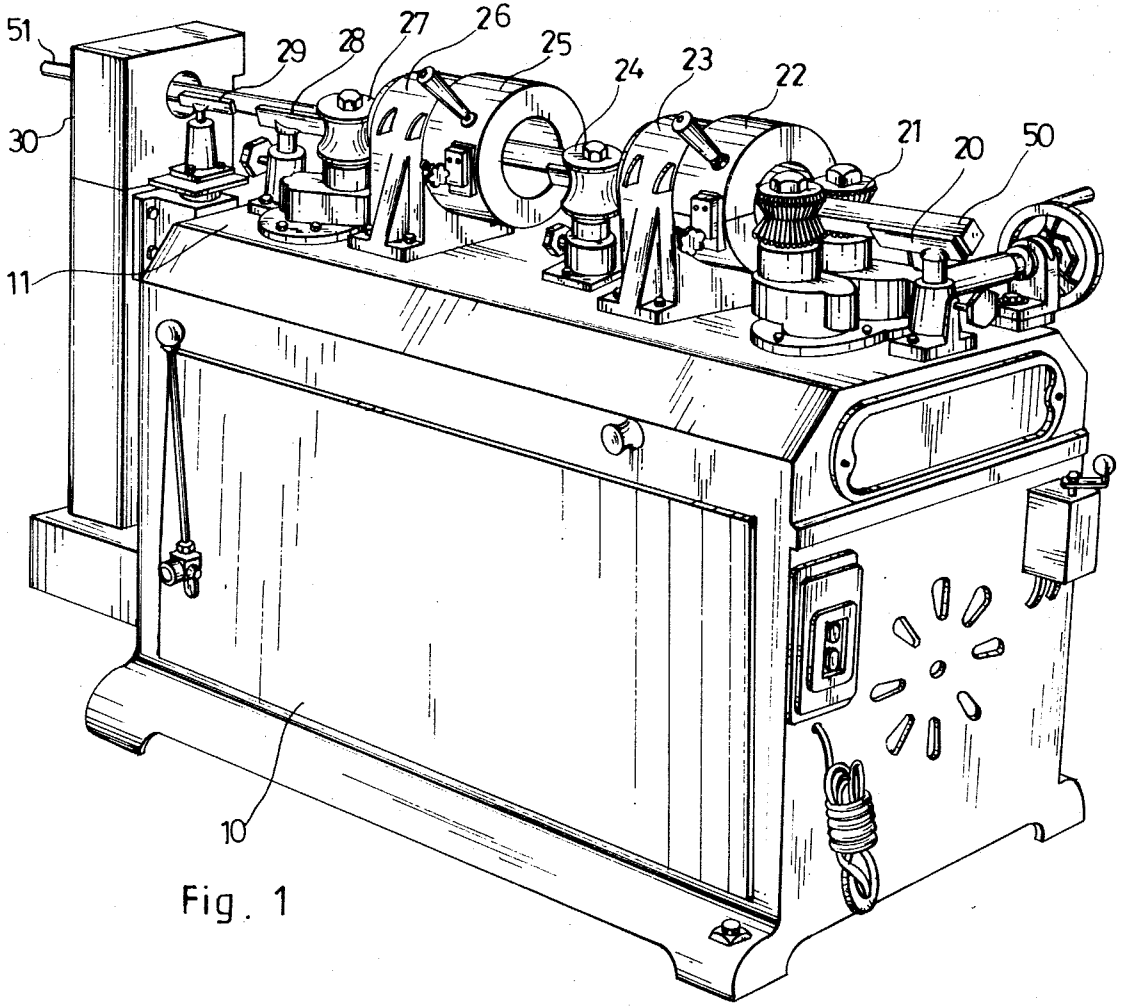
FIG. 1 is a perspective view of the wood bar rounding machine of this invention.
Figure 2:
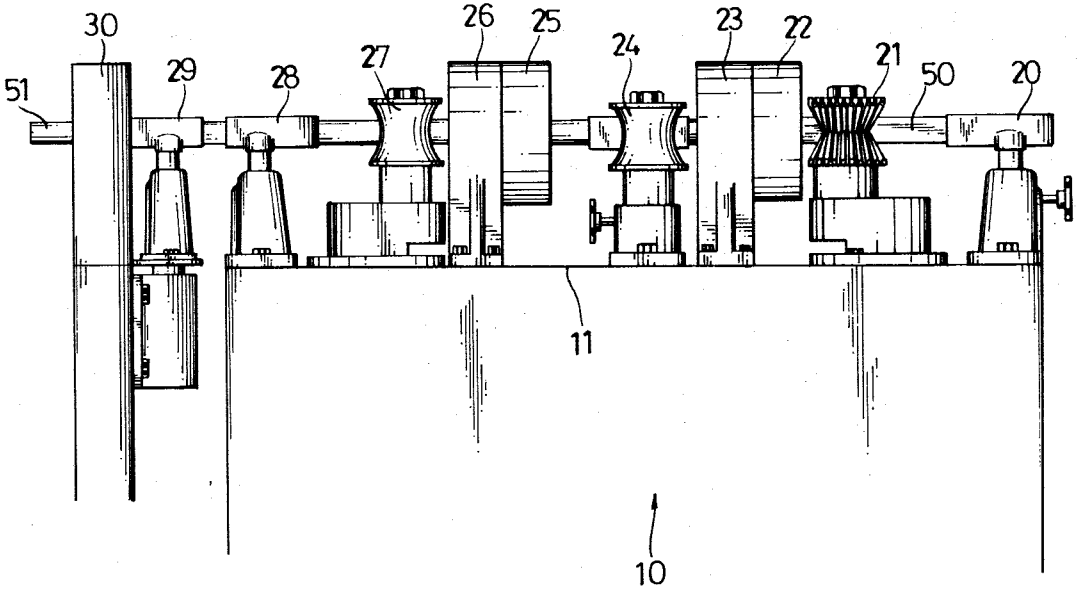
FIG. 2 illustrates the feeding and processing of the machine.
Figure 3:
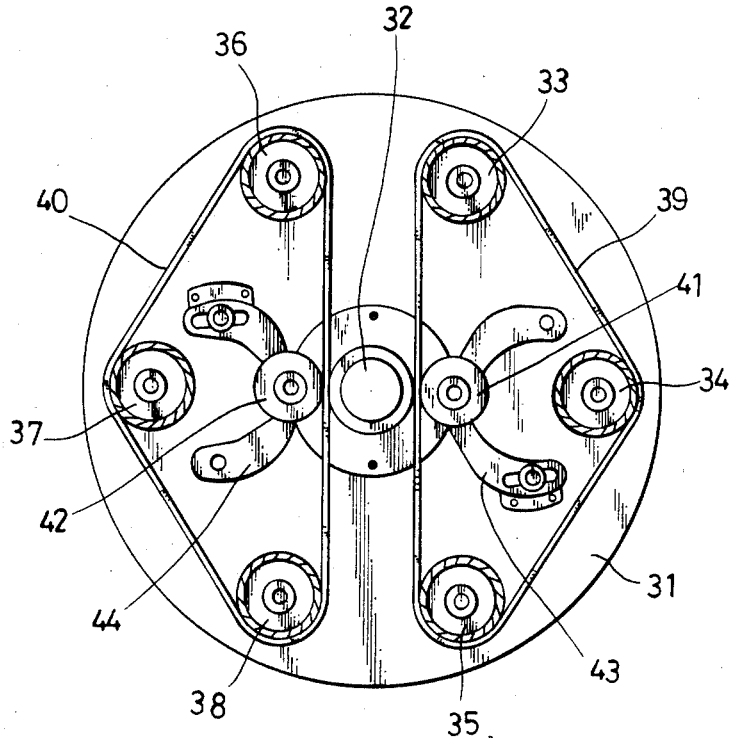
FIG. 3 is a cross section of the belt sander of the machine.

Referring now to the drawings, the nature of this invention is described as follows:

As shown in FIG. 1, the wood bar rounding machine comprises a stand 10, a bed 11, a front support 20, a front feed roller unit 21, a first cutting unit 22 with a motor 23, a middle feed unit 24, a second cutting unit 25 with a motor 26, a rear feed roller unit 27, two rear supports 28, 29, and a belt sander 30. The feeding, cutting and sanding units are arranged concentrically on the bed of the machine. The belt sander 30 has a plate 31. As shown in FIG. 3, the plate 31 of the belt sander 30 has a through hole 32 in the center, two sets of belt rollers 33, 34, 35, 36, 37, 38 arranged around the central hole 32 to form two triangles, two endles sand belts 39, 40 running respectively on one set of rollers 33, 34, 35 and the other set of rollers 36, 37, 38 with the part of belt 39 between the rollers 33 and 35 and the part of belt 40 between the rollers 36 and 38 passing by the central hole 32. In addition, two adjusting rollers 41, 42 and adjusting plates 43, 44 are provided respectively to adjust the belts 39, 40.

As shown in FIG. 1, the rectangular timber 50 is put on the front support 20 and fed by the front feed roller unit 21 into the first cutting unit 22 for rough cutting and into the second cutting unit 25 for fine cutting.

Then with the help of the rear feed roller unit 27, the rounded timber is fed into the belt sander 30 for smoothing. It becomes a rounded and polished wood bar after coming out of the belt sander 30. The plate 31 and rollers 33, 34, 35, 36, 37, 38 are driven by a motor and since the rollers 33, 34, 35 turns in different directions from the rollers 36, 37, 38, the belts 39, 40 run in different directions to facilitate the sanding of the wood bar. Depending on the size of the wood bar, the sand belts 39, 40 can be adjusted so as to be kpet in close contact with the wood bar. Additionally, the cutting units 22, 25 and the belt sander 30 are made in such way that they can be controlled separately for separate or synchronous operation.

I claim:

1. A wood shaping apparatus for shaping a work piece into an elongated cylindrical shape, which comprises:

a stand having front and rear portions.

a bed located on top of the stand, front feed rollers for feeding the work piece located on the bed near the front portion of the stand, a first cutting unit for rough cutting of the work piece attached to the bed behind the front feed rollers, middle feed rollers for feeding the work piece located on the bed behind the first cutting unit, a second cutting unit for fine cutting of the work piece attached to the bed behind the middle feed rollers, rear feed rollers for feeding the work piece located on the bed behind the second cutting unit, a sanding unit for polishing the work piece located at the rear portion of the stand behind the rear feed rollers and adjacent to the bed, the front feed rollers, first cutting unit, middle feed rollers, second cutting unit, rear feed rollers, and sanding unit being arranged concentrically, so that the work piece passes sequentially through the first cutting unit, the second cutting unit, and the sanding unit, while being driven by the front, middle and rear feed rollers.

2. The wood shaping apparatus as set forth in claim 1, wherein the sanding unit is a belt sanding unit having two belt sanding means for sanding opposites sides of the work piece.

3. A wood shaping apparatus as set forth in claim 2, wherein each belt sanding means has three rollers and a sand belt, the sand belt running on the three rollers, one of the three rollers being an adjustable roller for adjusting the sand belt.

4. The wood shaping apparatus as set forth in claim 1, wherein the sanding unit is a belt sanding unit having a cylindrical plate with a central hole for receiving the wood piece and two belt sanding means located on opposite sides of the central hole, the plate and the two belt sanding means being driven so that the two belt sanding means respectively rotate in different directions.

5. The wood shaping apparatus as set forth in claim 1, including front support means for supporting the work piece attached to the bed in front of the front feed rollers, and rear support means for supporting the work piece attached to the bed between the rear feed rollers and the sanding unit.

* * * * *